US007318259B2

(12) United States Patent
Uehara

(10) Patent No.: US 7,318,259 B2
(45) Date of Patent: Jan. 15, 2008

(54) BUCKLE

(75) Inventor: Ryoichiro Uehara, Toyama (JP)

(73) Assignee: YKK Corporation, Tokyo (JP)

( * ) Notice: Subject to any disclaimer, the term of this patent is extended or adjusted under 35 U.S.C. 154(b) by 9 days.

(21) Appl. No.: 11/107,683

(22) Filed: Apr. 15, 2005

(65) Prior Publication Data

US 2005/0235470 A1 Oct. 27, 2005

(30) Foreign Application Priority Data

Apr. 27, 2004 (JP) ..... 2004-130924

(51) Int. Cl.
*A44B 11/25* (2006.01)

(52) U.S. Cl. ..... 24/615; 24/614; 24/625; 24/618

(58) Field of Classification Search ..... 24/170, 24/171, 181, 190, 194, 196, 200, 265 BC, 24/265 EC, 592.1, 593.1, 594.1, 594.11, 24/598.1, 598.4, 697.1, 697.2, 614, 615, 24/625, DIG. 43–DIG. 48, DIG. 51, 618
See application file for complete search history.

(56) References Cited

U.S. PATENT DOCUMENTS

| | | | | | |
|---|---|---|---|---|---|
| 4,150,464 | A * | 4/1979 | Tracy | ..... | 24/313 |
| 4,864,700 | A * | 9/1989 | Kasai | ..... | 24/579.09 |
| 5,584,105 | A * | 12/1996 | Krauss | ..... | 24/614 |
| 5,737,810 | A * | 4/1998 | Krauss | ..... | 24/625 |
| 5,794,316 | A | 8/1998 | Anscher | | |
| 5,855,057 | A * | 1/1999 | Anscher | ..... | 24/614 |
| 5,991,985 | A * | 11/1999 | Galbreath | ..... | 24/625 |
| 6,311,374 | B1 | 11/2001 | Anscher | | |
| 6,446,314 | B1 * | 9/2002 | Anscher | ..... | 24/614 |
| 6,460,232 | B2 * | 10/2002 | Maruoka | ..... | 24/615 |
| 2001/0013159 | A1 * | 8/2001 | Maruoka | ..... | 24/615 |
| 2002/0040514 | A1 * | 4/2002 | Uehara et al. | ..... | 24/614 |
| 2003/0110605 | A1 * | 6/2003 | Nishida et al. | ..... | 24/615 |
| 2006/0053600 | A1 * | 3/2006 | Liu | ..... | 24/615 |

FOREIGN PATENT DOCUMENTS

| | | |
|---|---|---|
| EP | 0 467 574 | 1/1992 |
| EP | 0 815 761 | 1/1998 |
| EP | 1 400 183 | 3/2004 |
| GB | 2 127 090 | 4/1984 |
| JP | 8131215 | 5/1996 |
| JP | 10 211005 | 8/1998 |

* cited by examiner

*Primary Examiner*—Jack W. Lavinder
(74) *Attorney, Agent, or Firm*—Alston & Bird LLP

(57) ABSTRACT

A buckle which is an insertion type, wherein looseness between a buckle main body and an insertion body is eliminated and generation of impact sound or vibration sound is prevented, and in a resin buckle including the buckle main body formed of a housing and the insertion body having insertion leg portions on both sides, a concave guide groove is provided in a longitudinal direction of a center of an inner face of each of an upper face plate and a lower face plate of the housing of the buckle main body, while a guide lever which can be inserted into the guide groove provided in the housing is provided in a protruded form in a center of a proximal lever of the insertion body. A sliding contact portion which is elevated to make pressure contact with an opposing face is provided in part of the guide groove or the guide lever, or both the guide groove and the guide lever.

3 Claims, 8 Drawing Sheets

BUCKLE

BACKGROUND OF THE INVENTION

1. Field of the Invention

The present invention relates to an insertion type buckle comprising a housing-shaped buckle main body and an insertion body having leg portions for an insertion and more particularly, relates to a belt tightening buckle ordinarily used for clothing, bag, sport goods and the like.

2. Description of the Related Art

In a conventional insertion type buckle comprising the housing-shaped buckle main body 101 and the insertion body 102 having the insertion leg portions 131 on both right and left sides of the insertion body 102, as shown in FIG. 12, a pair of wall bodies 150 are provided longitudinally in a center of an inner face of a housing 120 of the buckle main body 101 between upper and lower plates of the buckle main body 101, and these wall bodies 150 form a wedge-shaped guide groove 105 in which its opening side is wide while its deep side is narrowed. A wedge-shaped small protrusion 151 projecting into the guide groove 105 is formed in a deep portion of this guide groove 105 and then a small and shallow wedge-shaped guide groove 152 is provided recessedly on the opening side of the guide groove 105. In the insertion body 102, a guide member 106, which can be inserted into the guide groove 105, is provided in a center of its proximal lever 130 such that it is projected forward, and a wedge-shaped small guide groove 153 which can be fitted to the small protrusion 151 provided on the buckle main body 101 is provided at a front end of the guide member 106. Further, a wedge-shaped small protrusion 154 which can be fitted to the small guide groove 152 provided in the guide groove 105 of the buckle main body 101 is provided on each of both front and rear surfaces of the guide member 106 at its proximal portion such that both of them overlap each other. As a result, this insertion type buckle have three positions in which the respective members engage each other firmly.

Further, according to another insertion type buckle, as shown in FIG. 13, a pair of guide pieces 255 are provided along the longitudinal direction in the center of the inner face of the housing 220 of the buckle main body 201 such that they are projected inward, so that a concave guide groove 205 is provided and then a guide lever 206 having a H-shaped cross section is provided protrudedly in the center of the proximal lever 230 and the guide lever 206 can be inserted into the guide groove 205.

Patent document 1: Japanese Patent Application Laid-Open No. 8-131215

Patent document 2: U.S. Pat. No. 5,794,316

Because in the insertion type buckle shown in FIG. 12, the guide groove 105, small protrusion 151 and small guide groove 152 provided in a housing 120 of the buckle main body 101 are all wedge-shaped and all the guide member 106, small guide groove 153 and small protrusion 154 disposed in the insertion body 102 are wedge-shaped, the buckle main body 101 and insertion body 102 are engaged with each other in a specified insertion range so that the position of the buckle in the longitudinal direction can be controlled. However, because there is no mechanism for restricting a swing of the buckle in the direction to front and rear surfaces, when the insertion leg portions 131 and guide member 106 of the insertion body 102 are inserted into the housing 120 of the buckle main body 101, looseness occurs and if this buckle is used in a bag or the like, impact sound or vibration sound is generated so as to make user feel discomfort.

Further, in case of the insertion type buckle shown in FIG. 13, when the guide lever 206 of the insertion body 202 is inserted into the guide groove 205 formed in the inner face of the housing 220 of the buckle main body 201, it is necessary to provide an allowance between the guide groove 205 and the guide lever 206 so as to secure a gap in order to insert the guide lever 206 into the guide groove 205 smoothly, because the thickness of the guide lever 206 is constant. However if the gap is provided, looseness occurs so that vibration sound is generated. Further, if the guide lever 206 is formed thick, when the guide lever 206 of the insertion body 202 is inserted into the housing 220 of the buckle main body 201, there is such a problem that the insertion operation cannot be performed smoothly because friction resistance is large.

SUMMARY OF THE INVENTION

The present invention has been achieved in consideration of the above-described problem and an object of a first aspect of the invention is to provide an insertion type buckle comprising a buckle main body formed of a housing and an insertion body having insertion leg portions on both sides and a guide lever in a center of the insertion body, wherein sliding contact faces, which make pressure contact with part of the buckle main body and the insertion body eliminating a gap in a direction to front and rear surfaces when the insertion leg portions and guide lever of the insertion body are inserted into the housing of the buckle main body, thereby preventing a swing of the buckle and blocking generation of impact sound or vibration sound, this insertion type buckle enabling a smooth insertion operation and ensuring an excellent quality with a simple structure.

Objects of second and third aspects of the invention are, in addition to the object of the first aspect, to provide an insertion type buckle, wherein in the sliding contact faces in which when the guide lever of the insertion body is inserted into the housing of the buckle main body, both of the sliding contact faces make pressure contact with each other, one of the sliding contact faces is formed of a flat face while the other one is formed of an elevated portion or one of them is formed as a recess while the other is formed of the elevated portion, in order to block swing of the buckle main body and insertion body thereby preventing generation of impact sound or vibration sound.

Objects of fourth, fifth and sixth aspects of the invention are, in addition to the object of the first aspect, to provide an insertion type buckle, wherein by specifying at which position the sliding contact portion to be provided on the guide groove and the guide lever should be provided on the guide groove or the guide lever, a relative swing between the housing of the buckle main body and the guide lever of the insertion body is blocked thereby preventing generation of the impact sound or vibration sound from the buckle.

Objects of seventh and eighth aspects of the invention are, in addition to the object of the first aspect, to provide an insertion type buckle, wherein the sliding contact portions which make pressure contact with an opposing face provided on the guide groove or the guide lever are provided on both faces or a single face, that is, the sliding contact portions are provided on both the upper and lower faces of the guide groove and the upper and lower faces of the guide lever or are provided on a single opposing face of the guide groove and a single opposing face of the guide lever, in order to block a relative swing between the housing of the buckle main body and the guide lever of the insertion body, thereby preventing generation of the impact sound or vibration sound from the buckle.

To achieve the above-described object, according to the first aspect, there is provided an insertion type buckle made of resin comprising a buckle main body formed of a housing and an insertion body having insertion leg portions on both sides of the insertion body, wherein the buckle main body includes a concave guide groove provided in a longitudinal direction of a center of an inner face of each of an upper face plate and a lower face plate of the housing; the insertion body includes a guide lever capable of being inserted into the guide groove provided within the housing, the guide lever provided in a center of a proximal lever so as to be protruded forward; and a sliding contact portion which makes pressure contact with an opposing face is disposed on part of the guide groove within the housing or the guide lever provided on the insertion body, or sliding contact portions are disposed on part of both of the guide groove and the guide lever.

According to the second aspect, there is provided the insertion type buckle according to the first aspect, wherein one side of the sliding contact portion which makes pressure contact with the opposing face is formed of a flat face while an other side thereof is formed of an elevated portion which is projected to the opposing face.

According to the third aspect, there is provided the insertion type buckle according to the first aspect, wherein one side of the sliding contact portion which makes pressure contact with the opposing face is formed of a recess while the other side thereof is formed of an elevated portion which is projected to the opposing face.

According to the fourth aspect, there is provided the insertion type buckle according to the first aspect, wherein the sliding contact portions which make pressure contact with respective opposing faces are disposed at a proximal portion of the guide lever provided in the insertion body and a distal end portion side of the guide groove provided within the housing, the distal end portion side mentioned here referring to a position corresponding to a front end portion of the guide lever when the guide lever of the insertion body is inserted into the guide groove.

According to the fifth aspect, there is provided the insertion type buckle according to the first aspect, wherein the sliding contact portions which make pressure contact with the respective opposing faces are disposed on faces in the guide groove provided within the housing, opposing a proximal portion and a front end portion of the guide lever provided on the insertion body.

According to the sixth aspect, there is provided the insertion type buckle according to the first aspect, wherein the sliding contact portions which make pressure contact with the respective opposing faces, are disposed at an insertion mouth portion and a distal end portion side of the guide groove provided within the housing and a proximal portion of the guide lever provided on the insertion body.

According to the seventh aspect, there is provided the insertion type buckle according to the first aspect, wherein the sliding contact portions disposed on the guide lever provided on the insertion body, making pressure contact with the opposing faces, are formed on both upper and lower surfaces, namely, both front and rear surfaces, and the sliding contact portions disposed in the guide groove provided within the housing, making pressure contact with the opposing faces, are formed in both upper and lower inner faces.

According to the eighth aspect, there is provided the insertion type buckle according to the first aspect, wherein the sliding contact portion disposed on the guide lever provided on the insertion body, making pressure contact with an opposing face is formed on a single face of the upper and lower faces, namely, the front and rear surfaces and the sliding contact portion disposed in the guide groove provided within the housing, making pressure contact with an opposing face is formed on a single face opposing the sliding contact portion formed on the guide lever provided on the insertion body.

According to the first aspect of the invention, the following effect can be exerted.

When the guide lever of the insertion body is inserted into the guide groove provided within the housing so as to engage the buckle main body with the insertion body, the guide groove and the guide lever make pressure contact with each other in a direction to the front and rear surfaces, so that they cannot deflect. Thus, unlike the conventional product in which the buckle main body and the insertion body deflect from each other, no impact sound or vibration sound is generated and because deflection to the right or left of the buckle is blocked by the insertion leg portions having a resilient performance, no impact sound or vibration sound is generated. Further, because the position in which the sliding contact portions of the guide groove and guide lever make pressure contact with each other acts as a mechanism which keeps the guide lever in a firm contact at the final stage of the insertion operation, the insertion operation of the guide lever can be carried out extremely smoothly.

According to the second and third aspects, the sliding contact portions provided in the guide groove provided within the housing of the buckle main body and on the guide lever provided on the insertion body have an extremely simple structure, which ensures the contact operation and blocks generation of the impact sound and vibration sound.

According to the fourth, fifth and sixth aspects, the sliding contact portions provided in the guide groove provided in the housing of the buckle main body and the guide lever provided on the insertion body are disposed only on part of the guide groove and guide lever, thereby exerting the pressure contact function effectively and blocking generation of the impact sound and vibration sound.

According to the seventh and eighth aspects, the sliding contact portions disposed on the guide lever and guide groove are disposed on faces opposing each other so that the pressure contact function can be exerted to the maximum extent. For the reason, the effects which the present invention exerts are remarkable.

DESCRIPTION OF THE PREFERRED EMBODIMENTS

Figure 1:
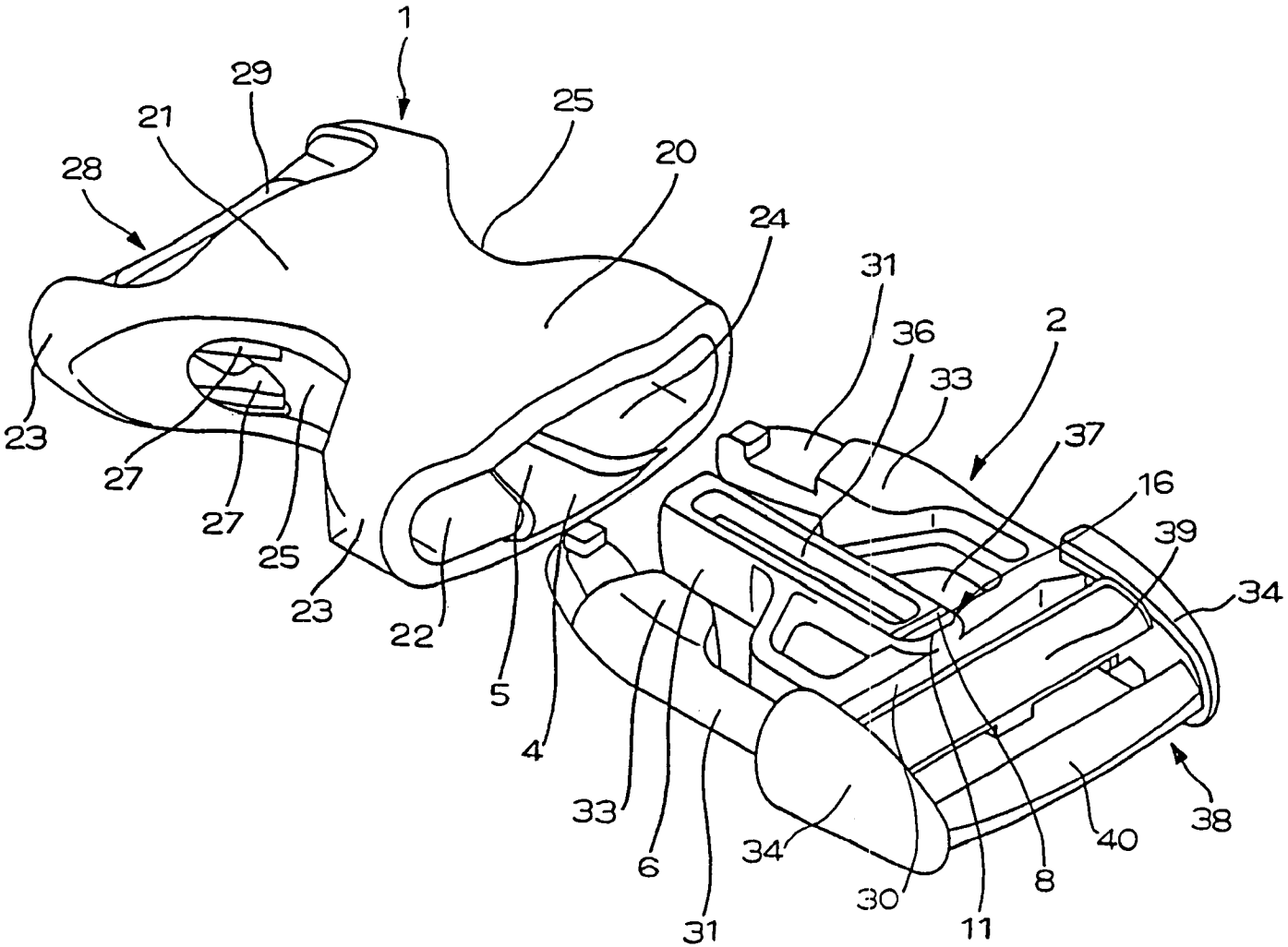
FIG. 1 is a perspective view of a buckle main body and an insertion body of an insertion type buckle.
Figure 2:
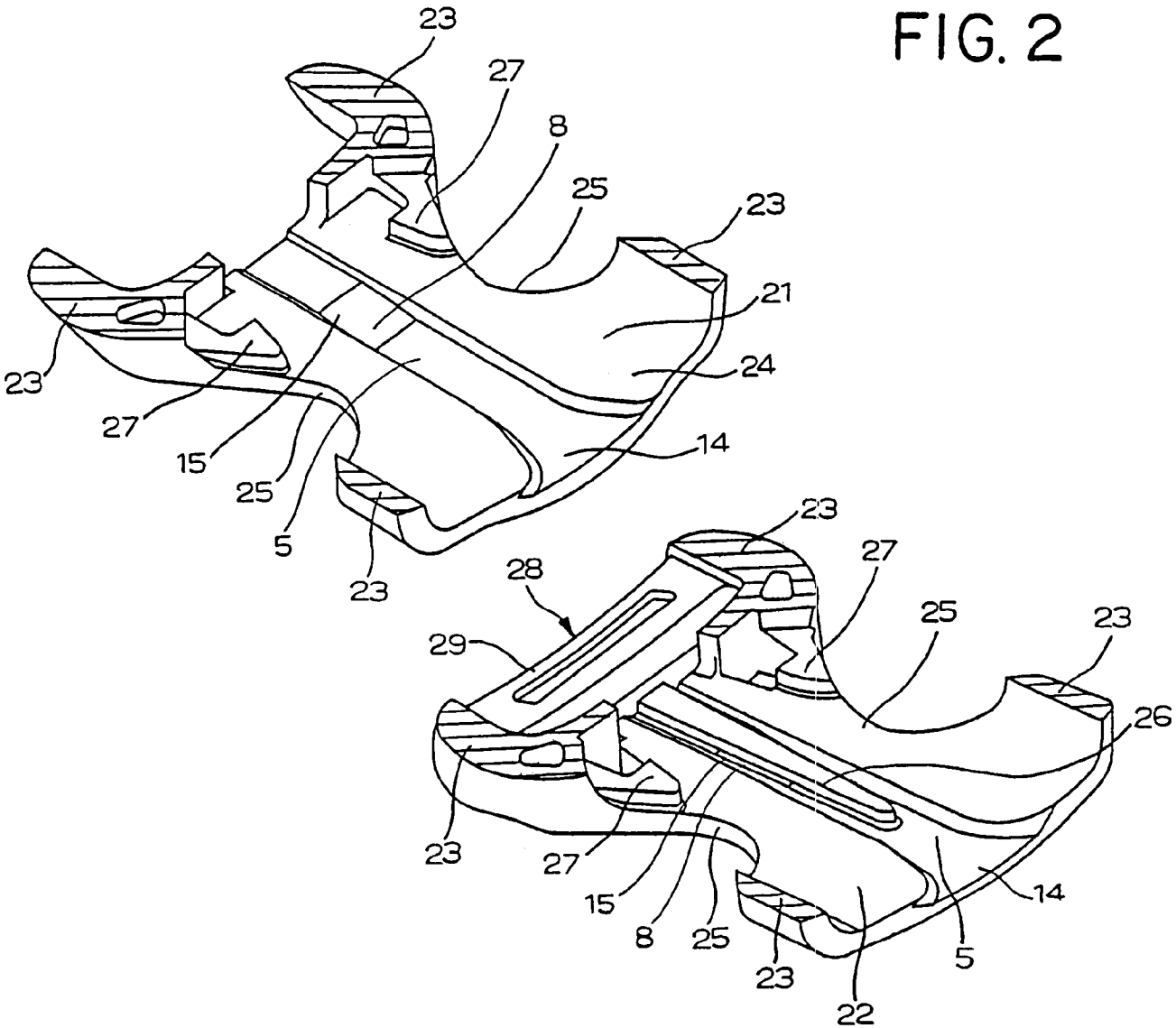
FIG. 2 is a perspective view of the buckle main body of the same buckle divided into two sections.
Figure 3:
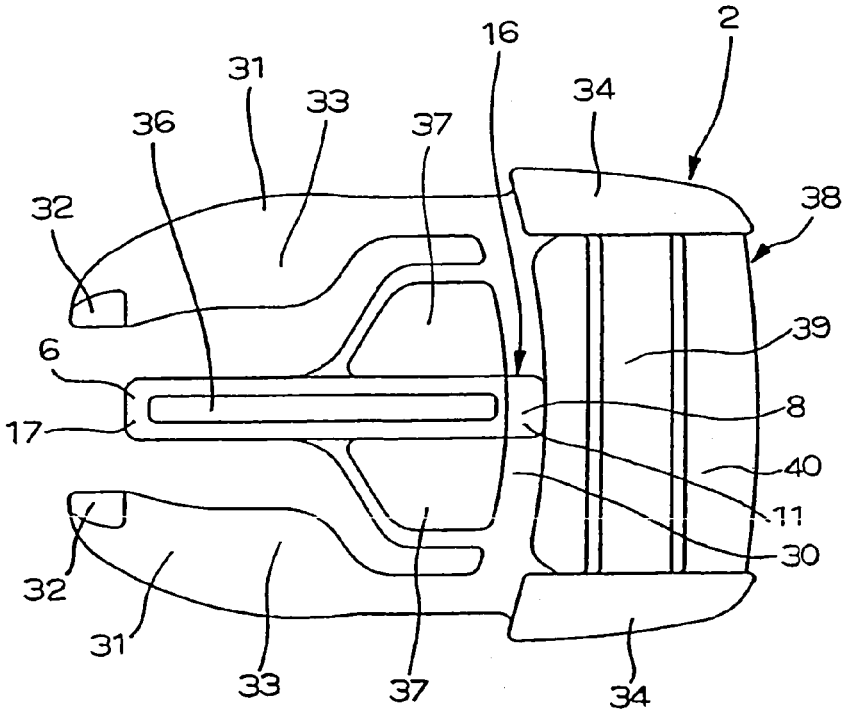
FIG. 3 is a front view of the insertion body of the same buckle.
Figure 4:
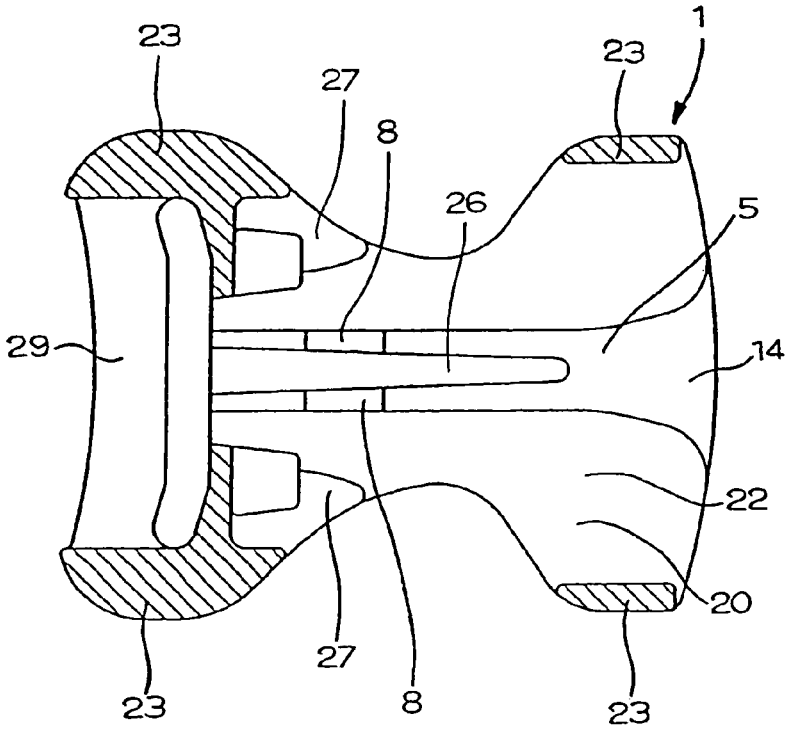
FIG. 4 is a horizontally sectional view of the buckle main body of the same buckle.

The buckle of the present invention is an insertion type buckle comprising a buckle main body 1 and an insertion body 2 which can be inserted into this buckle main body 1 as shown in FIG. 1 and both the buckle main body 1 and insertion body 2 are formed of thermoplastic resin with an injection molding means. The buckle main body 1 comprises a housing 20 and at an end of the housing 20 is provided an insertion mouth 24 into which insertion leg portions 31 and a guide lever 6 of the insertion body 2 can be inserted and at the other end is provided a belt mounting portion 28. On both sides of the buckle main body 1 are provided openings 25 which are formed by cutting out in an arcuate form so that operation portions 33 of the insertion leg portions 31 appear.

Inside the housing 20, a concave guide groove 5 is provided in a longitudinal direction of a center of an upper face plate 21, and a sliding contact portion 8, which is formed of a slope and a front end portion 17 of the guide lever 6 can make a firm contact with, is provided on a distal end portion side 15. A guide groove 5 is provided in a longitudinal direction of a center of a lower face plate 22 corresponding to the guide groove 5 of the upper face plate 21 and a slope sliding contact portion 8 is provided on the distal end portion side 15 corresponding to the sliding contact portion 8 of the upper face plate 21. Further, a projected portion 26 which is projected toward an insertion mouth 14 of the guide groove 5 is provided in the center of the guide groove 5 so that a concave groove portion 35 of the guide lever 6 is fitted thereto and guided thereby. On the side of the belt mounting portion 28 inside the housing 20 are provided hook-shaped engaging portions 27 which can engage engaging protrusions 32 of the insertion leg portions 31, the engaging portions being disposed protrudedly on the upper face plate 21 and the lower face plate 22.

In the insertion body 2, the insertion leg portions 31 are provided so as to be projected forward from both sides of the proximal lever 30 and a guide lever 6, which can be inserted into the guide groove 5 in the housing 20, is provided so as to be projected forward from the center of the proximal lever 30 and a flat face 10 is formed on each of upper and lower surfaces of this guide lever. However, elevated portions 11 are formed on the proximal portion of the guide lever such that they are projected upward and downward so as to form the sliding contact portions 8, so that they can make a pressure contact with the insertion mouth 14 of the guide groove 5. On the upper surface of the guide lever 6, there is provided a concave portion 36 which is extended from the proximal end 16 to the front end portion 17 with its front end closed. On the lower surface, there is provided a U-shaped concave groove portion 35 which is extended from the proximal portion 16 to the front end portion 17 with its front end open, so that it is capable of being fitted to the projected portion 26 provided in the guide groove 5. Reinforcement portions 37 are formed on the root of the guide lever 6 such that they are stretched sideway and then, the insertion leg portions 31 having the thick operation portions 33 in the middle thereof are provided so as to be projected forward from both portions of the proximal lever 30 on both sides of the reinforcement portions with each gap relative thereto. Engaging protrusions 32 capable of engaging the engaging portions 27 are provided on both the upper and lower surfaces at the front end of the insertion leg 31 and when the insertion leg portions 31 are inserted through the insertion mouth 24 of the housing 20, they are repelled outward so that they make a firm contact with side walls 23.

Figure 6:
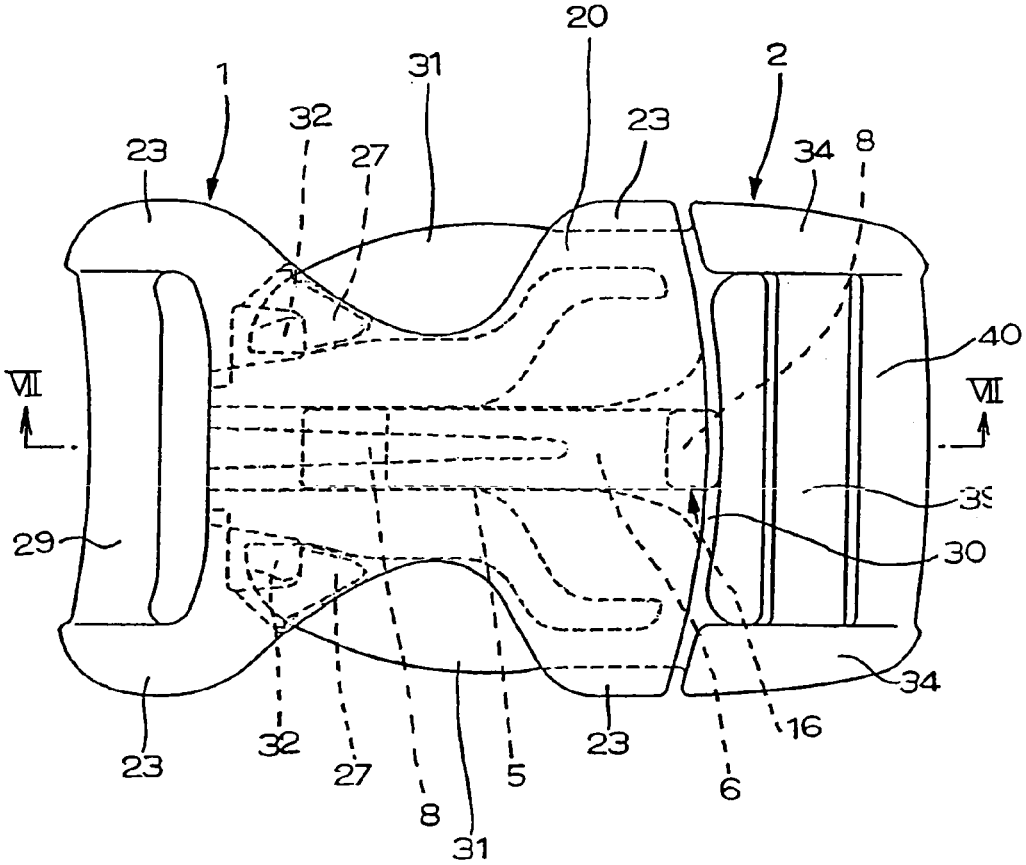
FIG. 6 is a front view of the same buckle when the insertion body is inserted.
Figure 7:
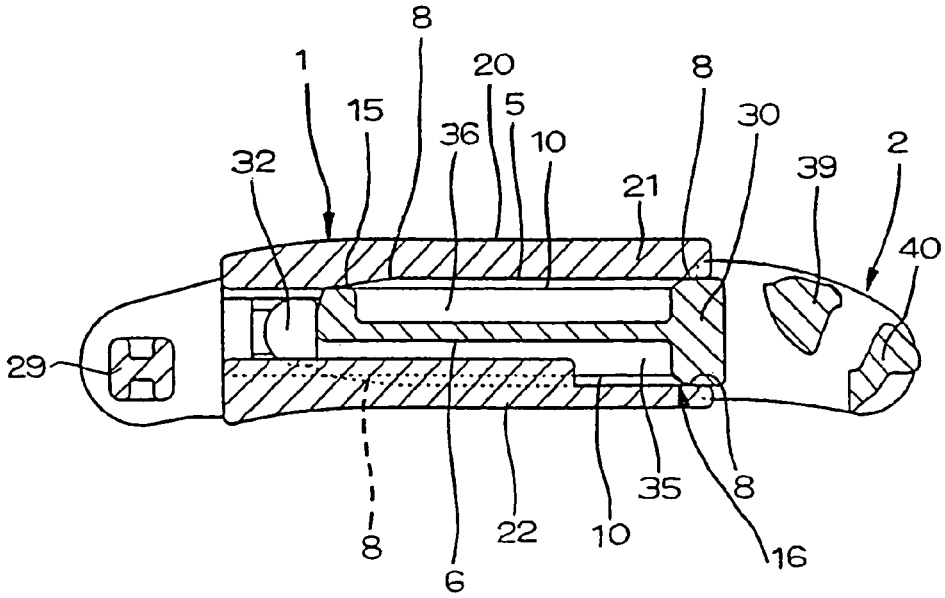
FIG. 7 is a sectional view taken along the line VII-VII in FIG. 6 of the same buckle.

As for the operation of the insertion type buckle, if the insertion leg portions 31 and the guide lever 6 of the insertion body 2 are inserted into the buckle main body 1, as shown in FIGS. 6 and 7, the sliding contact portions 8 comprising the elevated portions 11 formed on the upper and lower surfaces of the proximal portion 16 of the guide lever 6 make pressure contact with the insertion mouth portion 14 of the guide groove 5 provided in the upper face plate 21 and the lower face plate 22 of the housing 20 and at the same time, the front end portion 17 of the guide lever 6 makes pressure contact with the inclined sliding contact portions 8 on the upper and lower inner faces on the distal end portion side 15 provided in the guide groove 5. As a consequence, the guide lever 6 is held firmly by the insertion mouth portion 14 of the guide groove 5 on both the front and rear faces and the distal end portion side 15 through its proximal portions 16 on both the upper and lower faces and front end portion 17. Thus, the insertion body 2 never deflects vertically, that is, in the direction of the front/rear faces, within the buckle main body 1, thereby generating no impact sound or vibration sound.

FIRST EMBODIMENT

An insertion type buckle of an embodiment shown in FIGS. 1 to 8 will be described and as shown in FIG. 1, this insertion type buckle comprises the buckle main body 1 called socket and the insertion body 2 called plug which can be inserted into this buckle main body 1. The buckle main body 1 and the insertion body 2 are formed of thermoplastic resin such as polyamide, polyacetal, polypropylene, polybutylene terphthalate with an injection molding means.

The buckle main body 1 comprises the housing 20 surrounded by the upper face plate 21, the lower face plate 22 and the side wall 23 and at an end of the housing 20 is formed the insertion mouth 24 into which the insertion leg portions 31 and the guide lever 6 provided in the insertion body 2 can be inserted while the belt mounting portion 28 is formed at the other end by stretching a mounting lever 29 for mounting a belt between the side walls 23. Then, the openings 25 are provided on both sides of the housing 20 by cutting out in an arcuate fashion so that the operation portions 33 provided on the insertion leg portions 31 appear on the surface. Inside the housing 20 is provided the guide groove 5 which presents a concave configuration in a longitudinal direction of the center of the inner face of the upper face plate 21 and an inclined face, which can make pressure contact with the front end portion 17 of the guide lever 6, is provided on the distal end portion side 15 of this guide groove 5 so as to form the sliding contact portion 8.

The guide groove 5 is provided in the longitudinal direction of the center of the inner face of the lower face plate 22 of the housing 20 corresponding to the guide groove 5 provided in the upper face plate 21 and the sliding contact portion 8 providing an inclined face is provided on the distal end portion side 15 corresponding to the sliding contact portion 8 of the upper face plate 21 so that it makes a sliding contact with the guide lever 6. The projected portion 26, which is projected upward, is provided in the center of the concave guide groove 5 such that it is directed to the insertion mouth portion 14 and is fitted to the concave groove portion 35 provided in the guide lever 6 so as to guide the guide lever 6. The hook-shaped engaging portions 27, which can engage the engaging protrusions 32 formed at the front end of the insertion leg portions 31 of the insertion body 2 are provided protrudedly on the side of the belt mounting portion 28 on the upper face plate 21 and the lower face plate 22 of the housing 20 with a gap between the both.

In the insertion body 2, the insertion leg portions 31 are provided so as to be projected forward from both sides of the proximal lever 30 stretched between side frames 34 and the guide lever 6 which can be inserted into the guide groove 5 provided in the housing 20 is provided so as to be projected forward from the center of the proximal lever 30 and then, the flat face 10 is formed on each of the both upper and lower surfaces of this guide lever 6. By providing the elevated portions 11 which are projected upward and downward on the proximal portion 16 of the guide lever 6, the sliding contact portion 8 is formed so that it is capable of making a pressure contact with the insertion mouth portion 14 of the guide groove 5. The dented concave portion 36 whose front end is closed is provided in the top face of the guide lever 6 so that it is extended from the proximal portion 16 to the front end portion 17 and the concave groove portion 35, whose front end is open, entirely providing an U-shaped groove configuration, is provided in the lower face so that it is extended from the proximal portion 16 to the front end portion 17. This concave groove portion 35 is formed so as to be capable of being fitted to the projected portion 26 provided in the guide groove 5 of the housing 20 so as to guide it.

The reinforcement portions 37 stretched sideways are formed on the root of the guide portion 6 and the insertion leg portions 31 projected forward are provided on both sides of the reinforcement portions 37 with a gap so that they are projected forward from the both side portions of the proximal lever 30. This insertion leg portion 31 has the thick operation portion 33 in the middle thereof, which can be exposed from the opening 25 in the housing 20. On both the upper and lower faces at the front end of the insertion leg portion 31 are provided the engaging protrusions 32 capable of engaging the engaging portions 27 provided in the housing 20. The insertion leg portions 31 are repelled outward when they are inserted through the insertion mouth 24 of the housing 20 so as to make a pressure contact with the side walls 23. The mounting lever 39 for mounting a belt and a pressing portion 40 for blocking the belt from sliding by pressing are provided so as to be stretched between the side frames 34 so as to form the belt mounting portion 38.

Figure 5:
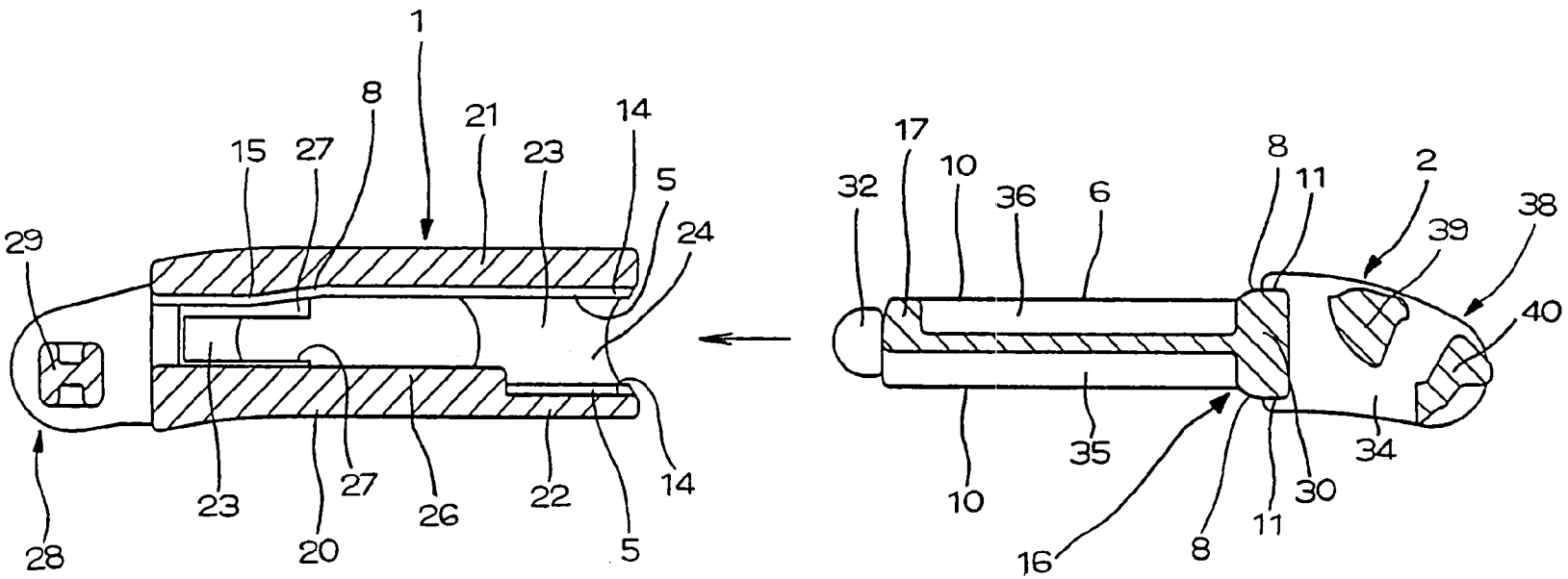
FIG. 5 is a longitudinally sectional view of the buckle main body and insertion body of the same buckle.
Figure 8:
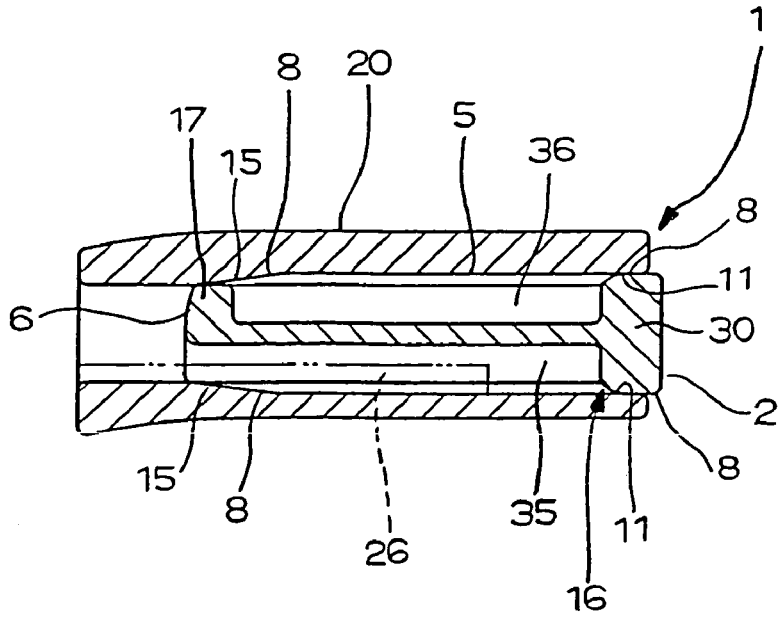
FIG. 8 is a sectional view of major portions when the guide lever is inserted into the guide groove in the same buckle.

As for the operation of the insertion type buckle, if the insertion body 2 is inserted into the buckle main body 1 as shown in FIG. 5, when the insertion leg portions 31 advance, their front ends advance along the inner edge of the hook-shaped engaging portion 27 pressing inward and at a termination, the insertion leg portions 31 are repelled outward so as to engage the engaging protrusions 32 with the engaging portions 27 so as to form a keying condition. At the same time, as shown in FIGS. 6, 7, and 8, the sliding contact portions 8 comprising the elevated portions 11 provided on the upper and lower faces of the proximal portion 16 of the guide lever 6 make pressure contact with the insertion mouth portion 14 of the guide groove 5 in the upper and lower inner faces of the housing 20 and at the same time, the front end portion 17 of the guide lever 6 makes pressure contact with the inclined sliding contact portions 8 on the upper and lower inner faces on the distal end portion side 15 provided in the guide groove 5. As a consequence, the guide lever 6 is held firmly by both the insertion mouth portion 14 and the distal end portion side 15 in the guide groove 5 through the proximal portion 16 on both the upper and lower faces and both the upper and lower faces of the front end portion 17. As a result, the insertion body 2 never deflects in the vertical direction or in the direction of the front/rear surfaces inside the buckle main body 1, thereby generating no impact sound or vibration sound.

SECOND EMBODIMENT

Figure 9:
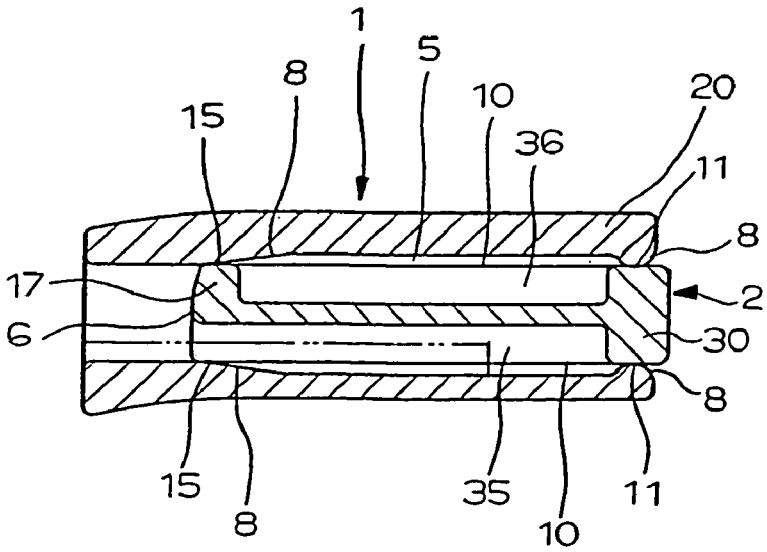
FIG. 9 is a sectional view of major portions when the guide lever is inserted into the guide groove in the buckle of the second embodiment.

An insertion type buckle of an embodiment shown in FIG. 9 indicates a modification of the guide groove 5 provided in the housing 20 of the buckle main body 1 and the sliding contact portion 8 disposed on the guide lever 6 provided in the insertion body 2. In the guide grooves 5 formed in the inner faces of the upper face plate 21 and the lower face plate 23 of the housing 20 of the buckle main body 1, the sliding contact portion 8 is provided by providing the elevated portion 11 which is projected inward in an arcuate fashion, at the insertion mouth portion 14 into which the guide lever 6 of the insertion body 2 can be inserted, while the sliding contact portion 8 providing an inclined face is formed on the distal end portion side 15 of each of the guide grooves 5 in the upper and lower inner faces.

In the guide lever 6 of the insertion body 2, its upper face and lower face are formed as the flat face 10 which is entirely flat from the proximal portion 16 to the front end portion 17. Thus, when the guide lever 6 is inserted into the guide grooves 5 in the upper and lower inner faces of the housing 20, the sliding contact portion 8 of the elevated portions 11 at the insertion mouth portion 14 provided in the guide groove 5 makes pressure contact with the proximal portion 16. Further, the inclined sliding contact portion 8 on the distal end portion side 15 makes pressure contact with the front end portion 17 of the guide lever 6 so that the guide lever 6 makes pressure contact with the sliding contact portions 8 at the front and rear positions of the housing 20 and is held firmly, never deflecting thereby generating no impact sound or vibration sound.

THIRD EMBODIMENT

Figure 10:
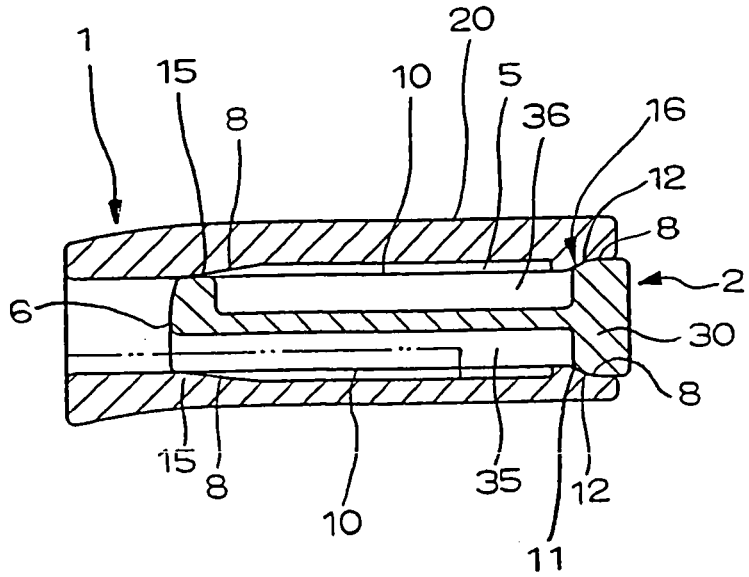
FIG. 10 is a sectional view of major portions when the guide lever is inserted into the guide groove in the buckle of the third embodiment.
Figure 11:
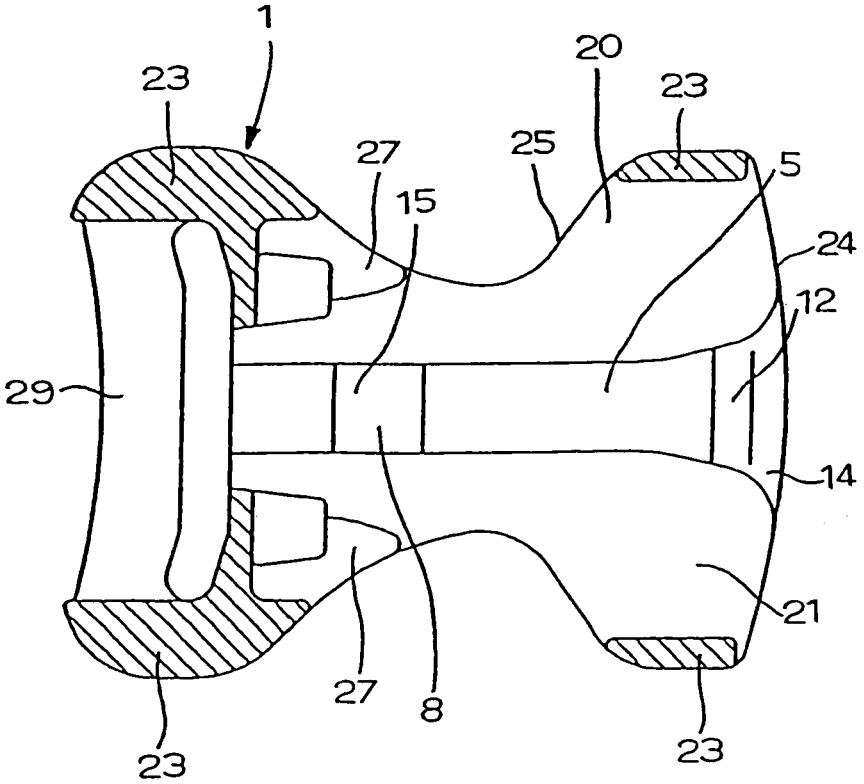
FIG. 11 is a horizontally sectional view of the buckle main body of the same buckle.
Figure 12:
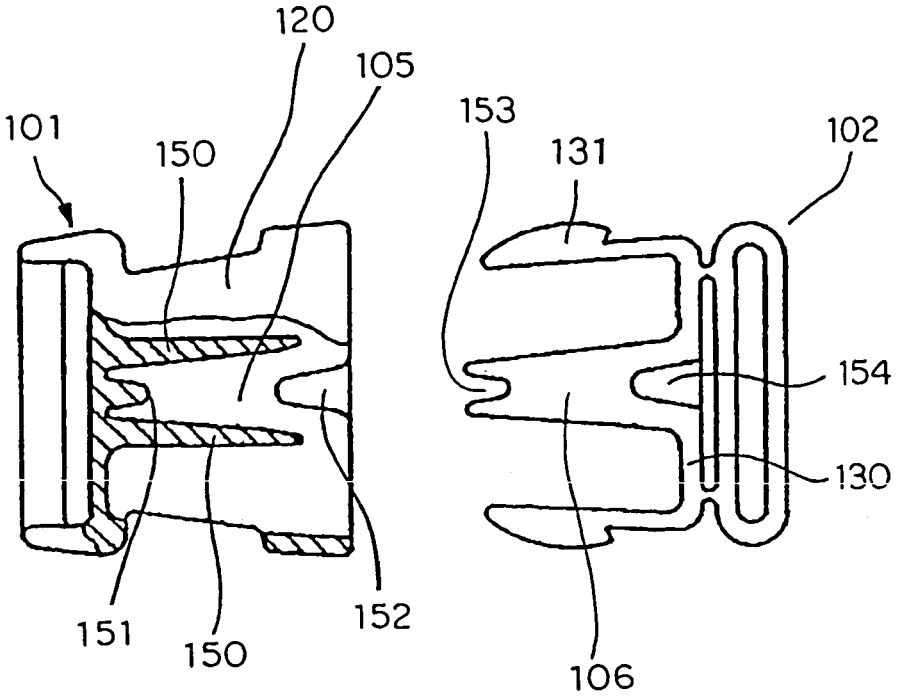
FIG. 12 PRIOR ART
FIG. 12 is a front view of a well known insertion type buckle.
Figure 13:
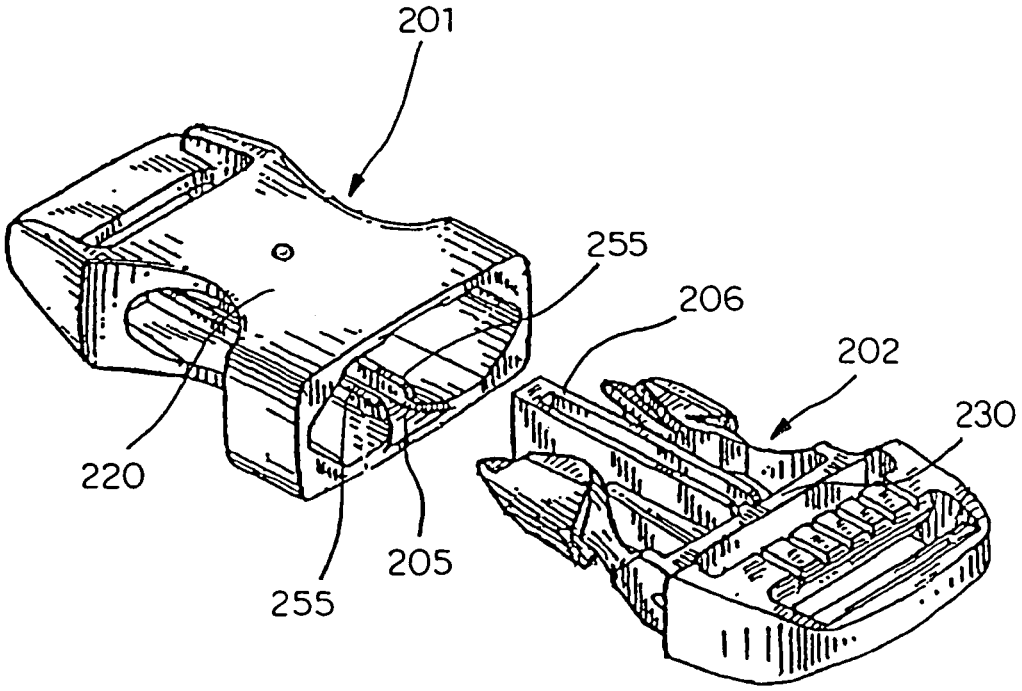
FIG. 13 PRIOR ART
FIG. 13 is a perspective view of other well known insertion type buckle.

An insertion type buckle of an embodiment shown in FIGS. 10 and 11 indicates a modification of the guide groove 5 provided in the housing 20 of the buckle main body 1 and the sliding contact portion 8 disposed on the guide lever 6 provided in the insertion body 2. In the guide grooves 5 formed in the inner faces of the upper face plate 21 and the lower face plate 22 of the housing 20 of the buckle main body 1, the sliding contact portions 8 are formed by providing the elevated portions 11 having a recess 12 at its vertex faces, which are projected inward of the insertion mouth portion 14 into which the guide lever 6 of the insertion body 2 is to be inserted. Additionally, the sliding contact portions 8 providing a slope are formed at the distal end portion side 15 of the guide grooves 5 in the upper and lower inner faces.

In the guide lever 6 of the insertion body 2, the sliding contact portion 8 is formed on the proximal portions 16 of the upper and lower faces by providing the elevated portions 11 which are projected outward and the recesses 12 formed in the guide groove 5 make pressure contact with the sliding contact portion 8 formed of the elevated portion 11. Further, the front end portion 17 of the guide lever 6 is capable of making pressure contact with the sliding contact portion 8 in which a slope is formed on the distal end portion side 15 of the guide groove 5. As a consequence, when the insertion body 2 is inserted into the housing 20, the guide lever 6 makes pressure contact with the sliding contact portion 8 at the insertion mouth portion 14 and the sliding contact portion 8 on the distal end portion side 15, provided in the guide groove 5 so that the guide lever 6 makes pressure contact with the sliding contact portions 8 at the front and rear positions in the housing 20, and consequently, the guide lever 6 is held firmly at the front and rear positions, never deflecting thereby generating no impact sound or vibration sound.

In the insertion type buckle of the present invention, its buckle main body and insertion body are formed of thermoplastic resin and this is used for firm tightening in clothing, bag and the like so as to prevent generation of impact sound or vibration sound during use thereof and to have excellent quality.

What is claimed is:

1. A buckle made of resin comprising a buckle main body formed of a housing and an insertion body having insertion leg portions on both sides of the insertion body, wherein the buckle main body is provided with a guide groove in a longitudinal direction of a center of an inner face of the housing; the insertion body is provided with a guide lever projecting from a center of a proximal lever, the guide lever being capable of being inserted into the guide groove, a first sliding contact portion, which makes sliding pressure contact with a first opposing face, is disposed on a part of the guide groove, a second sliding contact portion, which makes sliding pressure contact with a second opposing face, is disposed on a part of the guide lever, the first sliding contact portion is provided on a distal end portion side of the guide groove and has an inclined face narrowing toward the distal end portion side, and the second sliding contact portion is provided on a proximal portion of the guide lever, and is an elevated portion being elevated toward an insertion mouth portion of the guide groove.

2. The buckle according to claim 1, wherein the other sliding contact portion is formed of the elevated portion in which one face thereof is a flat face while an other face thereof is projected to the opposing face.

3. The buckle according to claim 1, wherein the elevated portion is provided on upper and lower faces of the proximal portion of the guide lever.

* * * * *